US012336595B2

(12) United States Patent
Mariacher

(10) Patent No.: US 12,336,595 B2
(45) Date of Patent: Jun. 24, 2025

(54) CLIMBING SHOE

(71) Applicant: CALZATURIFICIO S.C.A.R.P.A. S.P.A., Asolo (IT)

(72) Inventor: Heinrich Mariacher, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 0 days.

(21) Appl. No.: 18/195,158

(22) Filed: May 9, 2023

(65) Prior Publication Data

US 2024/0049832 A1 Feb. 15, 2024

(30) Foreign Application Priority Data

May 10, 2022 (IT) ..... 102022000009599

(51) Int. Cl.

| | |
|---|---|
| ***A43B 5/00*** | (2022.01) |
| ***A43B 23/26*** | (2006.01) |
| ***A43C 1/04*** | (2006.01) |
| ***A43C 11/00*** | (2006.01) |

(52) U.S. Cl.

CPC ..... *A43B 5/003* (2013.01); *A43B 23/26* (2013.01); *A43C 1/04* (2013.01); *A43C 11/008* (2013.01)

(58) Field of Classification Search

CPC .. A43C 1/00; A43C 1/003; A43C 1/02; A43C 1/04; A43C 11/00; A43C 11/008; A43C 11/1493; A43B 5/003

See application file for complete search history.

(56) References Cited

U.S. PATENT DOCUMENTS

| | | | | |
|---|---|---|---|---|
| 4,081,916 | A * | 4/1978 | Salisbury | A43C 11/008 36/50.1 |
| 5,027,482 | A * | 7/1991 | Torppey | A43C 11/1493 24/712.1 |
| 5,353,483 | A * | 10/1994 | Louviere | A43C 11/1493 24/712.1 |
| 5,970,629 | A * | 10/1999 | Tucker | A43C 11/00 36/51 |
| 2004/0078999 | A1* | 4/2004 | Freed | A43C 11/008 36/50.1 |
| 2018/0295942 | A1 | 10/2018 | Drake | |
| 2019/0313742 | A1 | 10/2019 | Bell et al. | |

FOREIGN PATENT DOCUMENTS

| | | | |
|---|---|---|---|
| EP | 3571949 | A1 | 11/2019 |
| JP | H10179210 | A | 7/1998 |

* cited by examiner

*Primary Examiner* — Ted Kavanaugh

(74) *Attorney, Agent, or Firm* — The Belles Group, P.C.

(57) ABSTRACT

A climbing shoe comprising: a shoe-upper shaped so as to accommodate the user's foot; a sole made of a polymeric material, which is attached to the bottom of the shoe-upper so as to cover at least the front part of the bottom of said shoe-upper; and manually-operated closing means that are adapted to tighten the top part of the shoe-upper on the user's foot and include a transversal locking strap that extends like a bridge between the inner side and the outer side of the shoe-upper remaining astride and grazing the top part of the shoe-upper, and is adapted to pull said inner and outer sides of the shoe-upper toward each other; said transversal locking strap comprising: a plate-like head which has, on at least one of the two major faces, a Velcro® surface structure; and a flexible cord that has a substantially unextendible structure.

12 Claims, 3 Drawing Sheets

CLIMBING SHOE

CROSS-REFERENCE TO RELATED APPLICATIONS

This patent application claims priority from Italian patent application no. 102022000009599 filed on May 10, 2022, the entire disclosure of which is incorporated herein by reference.

TECHNICAL FIELD

The present invention relates to a climbing shoe.

BACKGROUND

As is known, the currently most widespread climbing shoes comprise: a shoe-upper made of leather and/or fabric which is substantially sock-shaped so as to accommodate and cover the user's foot, comprising the sole of the foot; a front tensioning band with a ribbon-like structure, which is made of elastomeric material having high elasticity, is substantially U-bent, and is firmly fixed to the front part of the shoe-upper by gluing, so as to cover the tip and the inner and outer sides of the front part of the shoe-upper; a rear tensioning band with a ribbon-like structure, which is made of elastomeric material having high elasticity, is substantially U-bent, and is fixed by gluing to the rear part of the shoe-upper so as to cover the zone above the heel, and then extend obliquely along the two lateral sides of the shoe-upper up to reach and join the front tensioning band; and a bottom sole, which is made of a soft and flexible polymeric material with high friction coefficient and substantially inextensible, and is fixed by gluing to the bottom of the shoe-upper locally overlapping the front and rear tensioning bands, so as to cover the entire sole of the user's foot.

The front and rear tensioning bands are furthermore suitably pretensioned so as to embrace and tighten the shoe-upper on the user's foot.

The top part of the shoe-upper, in turn, is usually tightened on the instep of the user's foot by means of a traditional closing lace that pulls two longitudinal and opposite edges of the front-top part of the shoe-upper toward each other. In alternative to the lace, the two longitudinal edges of the shoe-upper can be pulled toward each other by a pair of hook-and-loop transversal straps, each of which has an end fixed by stitching to a first longitudinal edge of the shoe-upper, is U-folded on itself after engaging a return eyelet located on the second longitudinal edge of the shoe-upper, and is finally held in position by a Velcro® (e.g., hook-and-loop fastener/hook-and-loop surface structure) locking system located in the overlapping zone.

Unfortunately, despite offering a good capability to adapt to the morphology of the user's foot, the closing lace is unpleasant for most of the users, because its tensioning is rather long and laborious.

On the contrary, the hook-and-loop closing straps are very much appreciated by users because their tensioning is extremely simple and quick, even if the Velcro® (e.g., hook-and-loop fastener/hook-and-loop surface structure) locking system tends to loosen rather quickly and unfortunately requires a frequent repositioning of the straps, with the problems of use that this entail.

SUMMARY

Aim of the present invention is to provide a closing system of the front-top part of the shoe-upper that can overcome the above-described drawbacks, and is moreover more versatile than the ones currently in use.

In accordance with these aims, according to the present invention there is provided a climbing shoe as defined in claim 1 and preferably, though not necessarily, in any one of the dependent claims.

BRIEF DESCRIPTION OF THE DRAWINGS

The present invention will now be described with reference to the accompanying drawings, which illustrate a non-limiting example embodiment thereof, wherein:

FIG. 4 is a plan view of a component of the climbing shoe illustrated in the previous figures; whereas

DESCRIPTION OF EMBODIMENTS

Figure 1:
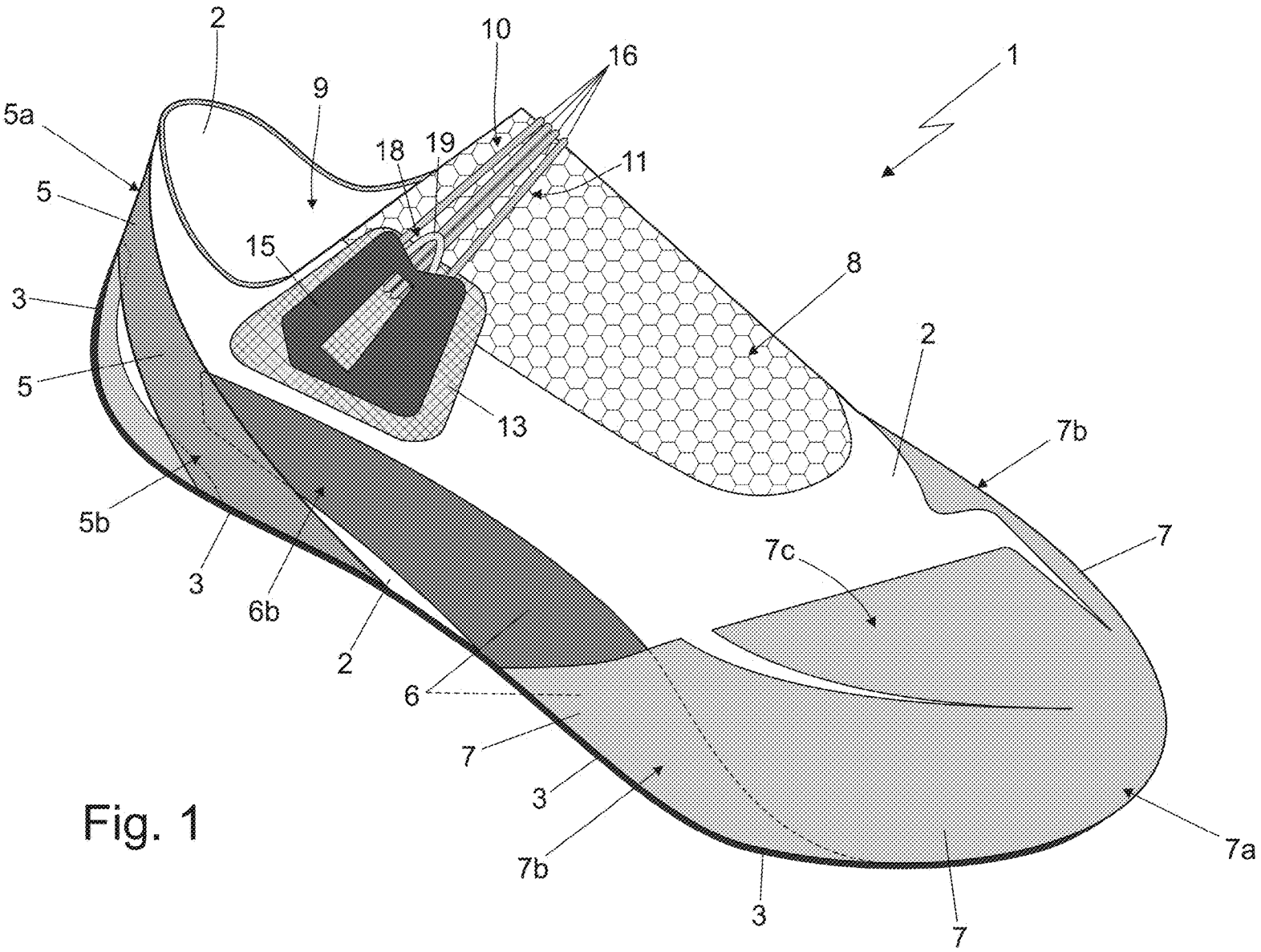
FIG. 1 is a schematic perspective view of a climbing shoe realized according to the teachings of the present invention, with parts removed for clarity's sake.
Figure 2:
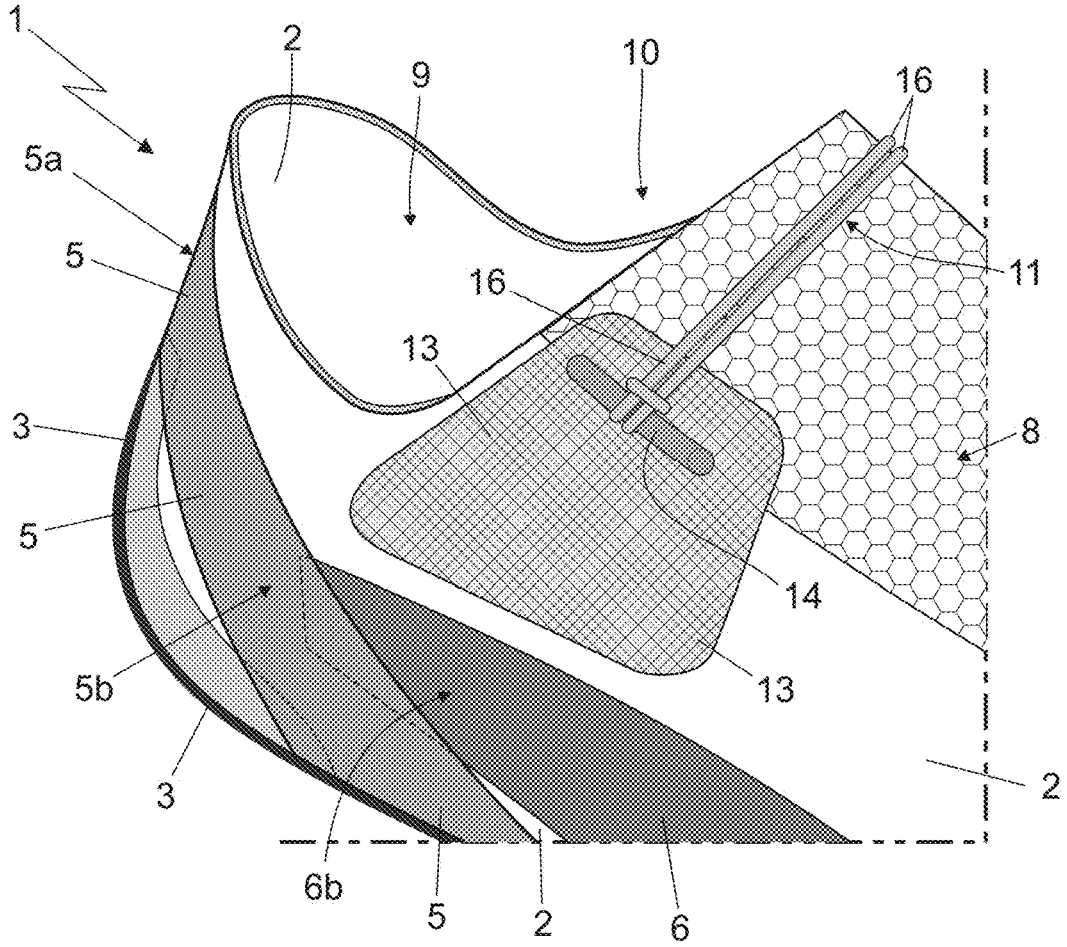
FIG. 2 is an enlarged view of the rear part of the climbing shoe illustrated in FIG. 1, with parts removed for clarity's sake.
Figure 3:
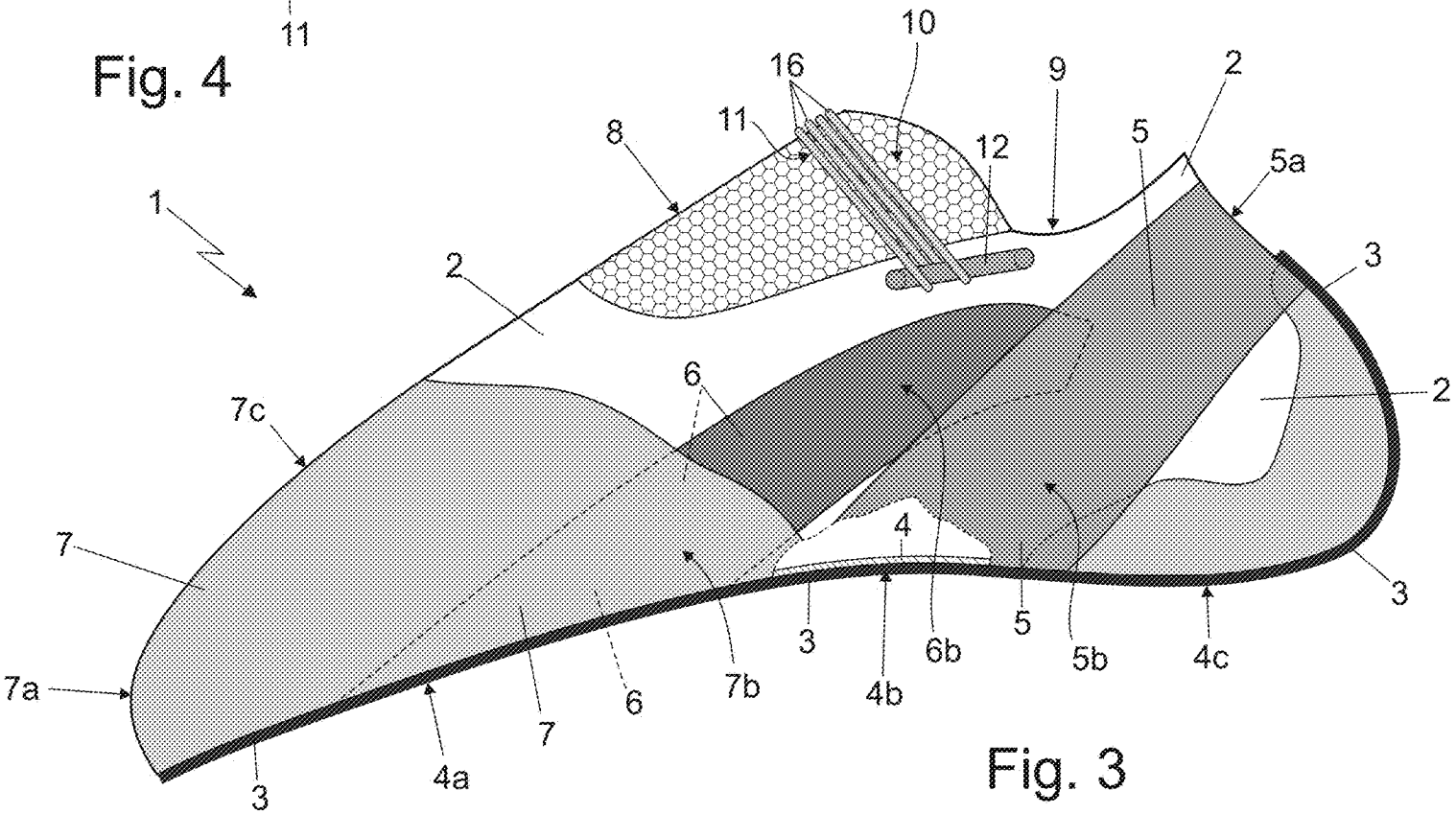
FIG. 3 is a side view of the climbing shoe illustrated in FIG. 1, with parts in section and parts removed for clarity's sake.

With reference to FIGS. 1, 2 and 3, reference numeral 1 denotes, as a whole, a climbing shoe which may be particularly advantageously used for climbing rock walls classified as grade III or higher.

The climbing shoe 1 firstly comprises: a shoe-upper 2 preferably made of leather and/or fabric, which is substantially sock-shaped so as to accommodate and completely envelop the user's foot, the sole of the foot included; and a sole 3 which is made of a soft and flexible polymeric material, with a high friction coefficient and preferably also substantially inextensible, and is firmly fixed to the bottom 4 of the shoe-upper 2 preferably by gluing, so as to cover at least the front part of the bottom 4 of the shoe-upper 2.

More specifically, the bottom 4 of shoe-upper 2, i.e. the piece of the shoe-upper 2 that covers the sole of the user's foot, is longitudinally divided into a front section 4*a* that conventionally is located immediately beneath the phalangeal region of the sole of the user's foot; into a central section 4*b* that conventionally is located immediately beneath the metatarsal region of the sole of the user's foot, i.e. below the plantar arch; and into a rear section 4*c* that conventionally is located immediately beneath the astragalus-calcaneus region of the sole of the user's foot.

The sole 3 is preferably shaped/dimensioned so as to substantially entirely cover the bottom 4 of the shoe-upper 2, optionally also rising up along the rear part of the shoe-upper 2 so as to also cover the heel of the user's foot.

Preferably, the sole 3 is moreover made of a polymeric material having a hardness (UNI 4916) preferably less than 80 ShoreA and advantageously ranging between 50 and 75 ShoreA.

More specifically, in the example shown, the front sole 3 is preferably made of a soft and flexible polymeric material, such as for example the blend XS GRIP 2 produced by the Italian company VIBRAM S.P.A.

Clearly, in a different embodiment the sole 3 may be shaped/dimensioned so as to substantially entirely cover only the front section 4*a* of the bottom 4 of shoe-upper 2 and advantageously also a limited part of the adjacent central section 4*b*.

In other words, the sole 3 may be shaped/dimensioned so as to leave uncovered the rear section 4*c* of the bottom 4 of the shoe-upper 2.

With reference to FIGS. 1, 2 and 3, additionally the climbing shoe 1 comprises also at least one and more conveniently a plurality of elastic tensioning bands, which are made of elastomeric material with high elasticity and are firmly fixed to the shoe-upper 2, or rather to the outer surface of the shoe-upper 2, preferably seamlessly and preferably by gluing, so as to embrace and tighten the shoe-upper 2 on the user's foot. Preferably, the tensioning bands are furthermore pretensioned.

In other words, each tensioning band has an elastically-deformable monolithic structure and has an elastic modulus (Young modulus) considerably lower than that of the sole 3.

More specifically, the tensioning bands advantageously have an elastic modulus 2-10 times lower than that of the sole 3.

Additionally, the elastomeric material forming at least one and more conveniently each tensioning band, preferably has a hardness (UNI 4916) greater than that of the polymeric material forming the sole 3.

More specifically, with reference to FIGS. 1, 2 and 3, the climbing shoe 1 is preferably provided with a rear tensioning band 5 having a ribbon-like monolithic structure, which is U-bent and is located astride the rear part of the shoe-upper 2, so that its curved central segment 5*a* covers the zone of the shoe-upper 2 above the heel of the user's foot, and that its two oblong lateral segments 5*b* extend obliquely along the inner and outer lateral sides of the shoe-upper 2, up to reach the bottom 4 preferably substantially at the central section 4*b* thereof.

Preferably, the two ends of rear tensioning band 5 moreover extend/prolong on the bottom 4 of shoe-upper 2 toward each other, underneath the sole 3.

More specifically, the two ends of the rear tensioning band 5 extend/prolong on the bottom 4 of shoe-upper 2 within the central section 4*b* of the bottom 4 and optionally also within the front section 4*a* and/or the rear portion 4*c* of the bottom 4.

Additionally, the rear tensioning band 5 is preferably also pretensioned, and is preferably firmly fixed to the outer surface of the shoe-upper 2 substantially seamlessly by gluing.

With reference to FIGS. 1, 2 and 3, the climbing shoe 1 is preferably also provided with a central tensioning band 6 with a ribbon-like monolithic structure, separate and distinct from the rear tensioning band 5, which is substantially V-shaped, has the vertex or central segment located on the bottom 4 of shoe-upper 2, underneath the sole 3 at the front section 4*a* of the bottom 4, and has the two oblong lateral segments 6*b* which extend obliquely toward the rear part of the shoe-upper 2, along the inner and outer lateral sides of the shoe-upper 2, up to reach and firmly join the rear tensioning band 5 preferably along the two oblong lateral segments 5*b* of the latter.

Similar to the rear tensioning band 5, also the central tensioning band 6 is preferably pretensioned, and is preferably firmly fixed to the outer surface of the shoe-upper 2 substantially seamlessly by gluing.

Preferably, the central tensioning band 6 is moreover dimensioned so as to bend downward the tip of the user's foot in a banana-like manner.

Therefore, during the climbing, the central tensioning band 6 withstands the straightening of the tip of the user's foot.

Additionally, the climbing shoe 1 is preferably also provided with a front tensioning band 7 having a ribbon-like monolithic structure, separate and distinct from the tensioning bands 5 and 6, which is U-bent and is located astride the ogival front part of the shoe-upper 2, so that its curved central segment 7*a* covers the tip of the shoe-upper 2, and that its two oblong lateral segments 7*b* extend along the inner and outer lateral sides of the shoe-upper 2, remaining contiguous to the sole 3, preferably up to reach and overlap the central tensioning band 6 along the two oblong lateral segments 6*b* of the latter.

The front tensioning band 7 is furthermore shaped so as to also extend on the bottom 4 of the shoe-upper 2 underneath the sole 3, for partially covering the front section 4*a* and optionally also the central section 4*b* of the bottom 4, preferably overlapping the central tensioning band 6 in the mutual overlapping zones.

Preferably, the front tensioning band 7 is moreover provided with a lateral flap 7*c* which extends on the front-top part of the shoe-upper 2 to cover and protect the toes of the user's foot, and seamlessly joins the curved central segment 7*a*.

Similar to the rear tensioning band 5, also the front tensioning band 7 is preferably pretensioned, and is preferably firmly fixed to the outer surface of the shoe-upper 2 substantially seamlessly by gluing.

With reference to FIGS. 1, 2 and 3, the top part of the shoe-upper 2 is preferably moreover provided with an oblong-shaped elasticized portion 8, which extends from the top opening 9 of shoe-upper 2 toward the tip, while remaining substantially astride the midplane of the footwear, so as to cover the instep of the user's foot.

The climbing shoe 1 is additionally provided with a manually-operated and adjusted closing device 10, which is arranged astride and grazing the top part of the shoe-upper 2, or rather astride and grazing the elasticized portion 8, and is adapted to tighten the top part of the shoe-upper 2 on the user's foot, so as to lock/hold the foot inside the footwear.

More specifically, the closing device 10 includes a transversal locking strap 11, which extends like a bridge between the two lateral sides of shoe-upper 2, astride and grazing the top part of the shoe-upper 2, or rather astride and grazing the elasticized portion 8, transversally to the midplane of the footwear, and is adapted to pull the two lateral sides of the shoe-upper 2 toward each other, so as to lock/hold the foot inside the footwear.

Additionally, the transversal locking strap 11 is coupled/attached in an easily removable manner both to the inner lateral side and to the outer lateral side of the shoe-upper 2, so as to be completely detachable from the shoe-upper 2.

In other words, the transversal locking strap 11 is completely separate and distinct from the shoe-upper 2.

With reference to FIGS. 1, 2 and 3, the closing device 10 in particular comprises: a first loop 12 which is located on the inner lateral side of the shoe-upper 2, preferably close to the elasticized portion 8 and/or the top opening 9; a flat anchoring flap or insert 13, which is located on the outer lateral side of the shoe-upper 2, preferably close to the elasticized portion 8 and/or the top opening 9, and is provided, on the exposed face, with a first Velcro® (e.g., hook-and-loop fastener/hook-and-loop surface structure) surface structure; and preferably also a second loop 14 which is located on the outer lateral side of the shoe-upper 2, immediately above the anchoring flap/insert 13.

Preferably, the loop 12 and the anchoring flap/insert 13 are moreover located on the inner and outer lateral sides, respectively, of the shoe-upper 2 in a substantially specular position with respect to the midplane of the footwear, advantageously on opposite sides of elasticized portion 8.

The locking strap 11, in turn, has a flexible and preferably also substantially inextensible structure, and is couplable in an easily removable manner both to the loop 12 and to the anchoring flap/insert 13, and optionally also to the loop 14.

More specifically, with reference to FIGS. 1, 2, 3 and 4, the transversal locking strap 11 comprises: a plate-like head 15 preferably with a semi-rigid structure, which has, on at least one of the two major faces, a second Velcro® (e.g., hook-and-loop fastener/hook-and-loop surface structure) surface structure; and a flexible cord 16 with a substantially inextensible structure, which has the two ends firmly fixed to the plate-like head 15, preferably on the sidewall of the head, and is dimensioned so as to form a large, substantially U-shaped bight or eye 17, which has a nominal length $\ell$ preferably ranging between 5 and 30 cm (centimetres).

The Velcro® (e.g., hook-and-loop fastener/hook-and-loop surface structure) surface structure present on at least one of the two major faces of the plate-like head 15 is moreover complementary to that of the anchoring flap or insert 13, so that the plate-like head 15 can hook/attach firmly, though in an easily removable and adjustable manner, onto the anchoring flap or insert 13.

The bight or eye 17 formed by the flexible cord 16, on the other hand, is adapted to be threaded into and/or knotted to the loop 12 and optionally also into/to the loop 14.

Additionally, the plate-like head 15 is preferably shaped and dimensioned so as not to be able to pass through the loop 12 and optionally also the loop 14, and is preferably provided with a semi-rigid foldable structure, so as to be able to pass through the loop 12 and optionally also the loop 14 in a folded configuration.

More specifically, the plate-like head 15 has an elastically deformable semi-rigid structure and remains stably in a flattened/unfolded configuration, but can be book-folded on itself so as to temporarily assume a folded configuration.

In the folded configuration, the plate-like head 15 manages to pass through the loop 12, whereas in the flattened/unfolded configuration, the plate-like head 15 does not manage to pass through the loop 12.

Preferably, when it is in the folded configuration, the plate-like head 15 moreover manages to pass through the loop 14.

In other words, the maximum width of the plate-like head 15 in the flattened/unfolded configuration is greater than the nominal width of the loop 12 and preferably also of the loop 14. Instead, the maximum width of the plate-like head 15 in the folded configuration is less than the nominal width of loop 12 and preferably also of that of loop 14.

Additionally, the plate-like head 15 is preferably substantially polygonal in shape, and the two ends of the flexible cord 16 are preferably firmly fixed to the plate-like head 15 spaced apart from each other, advantageously on a same side of the polygon or on two preferably, though not necessarily, consecutive sides of the polygon.

Figure 4:
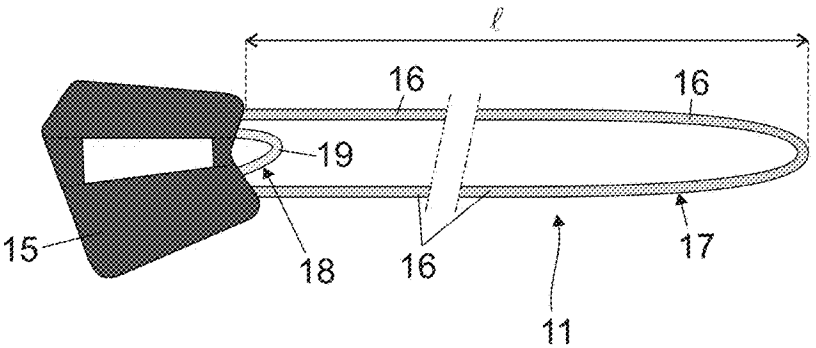

With reference to FIGS. 1 and 4, preferably the plate-like head 15 is furthermore also provided with a small supplementary loop 18, which is selectively engageable by the bight 17 formed by the flexible cord 16.

Preferably, the supplementary loop 18 is moreover made up of a second flexible cord 19 with a substantially inextensible structure, separate and distinct from the flexible cord 16, which has the two ends firmly fixed to the plate-like head 15, preferably on the sidewall of the head and preferably between the two ends of the flexible cord 16, and is dimensioned so as to form a second substantially U-shaped bight, which has a length less than that of the bight 17 and can be engaged, in case of need, by the bight 17 formed by the flexible cord 16.

With reference to FIGS. 1 and 4, in the example shown, in particular, the loop 12 is preferably made up of a small cord with a flexible and substantially inextensible structure, which extends grazing the shoe-upper 2, close to the edge of the elasticized portion 8, and has the two ends firmly fixed to the shoe-upper 2 advantageously by stitching and/or gluing.

The anchoring flap or insert 13, on the other hand, is preferably made up of a Velcro® (e.g., hook-and-loop fastener/hook-and-loop surface structure) fabric patch, which is located on the outer side of the shoe-upper 2, advantageously astride the edge of the elasticized portion 8, and is firmly fixed to the shoe-upper 2 advantageously by stitching and/or gluing.

The loop 14, in turn, is preferably made up of a small cord with a flexible and substantially inextensible structure, which extends grazing the anchoring flap/insert 13, or rather the Velcro® (e.g., hook-and-loop fastener/hook-and-loop surface structure) fabric patch, close to the edge of the elasticized portion 8, and has the two ends firmly fixed to the anchoring flap/insert 13 and/or to the shoe-upper 2 advantageously by stitching and/or gluing.

As regards instead the transversal locking strap 11, the plate-like head 15 is preferably substantially quadri-lateral in shape, and more specifically approximately trapezoidal in shape, and is preferably made of plastic material.

Preferably, the two ends of flexible cord 16, and optionally also the two ends of flexible cord 19, are moreover embedded in the body of plate-like head 15.

In a different embodiment, however, the plate-like head 15 may also be made of leather or other similar material.

The flexible cord 16, in turn, has a total length preferably ranging between 30 and 40 cm (centimetres), whereas the flexible cord 19 has a total length preferably ranging between 3 and 4 cm (centimetres)

General operation of the climbing shoe 1 is easily inferable from what written above and does not require further explanations.

As regards instead the closing device 10, with reference to FIGS. 1, 2 and 3, the transversal locking strap 11 has the distal end of the bight 17 fixed to the loop 14 preferably by means of a Cow hitch, the central section of the bight 17 threaded into the loop 12 in free slidable manner, and the plate-like head 15 overlapped and attached to the anchoring flap/insert 13.

In a different configuration, the transversal locking strap 11 has the distal end of the bight 17 fixed to the supplementary loop 18 of the plate-like head 15 preferably by means of a Cow hitch, the central section of the bight 17 threaded into the loop 12 in free slidable manner, and the plate-like head 15 overlapped and attached to the anchoring flap/insert 13.

The advantages associated with the particular structure of the closing device 10 are remarkable.

Firstly, the plate-like head 15 and the anchoring flap/insert 13 have a much wider Velcro® (e.g., hook-and-loop fastener/hook-and-loop surface structure) part with respect to the one present in the traditional hook-and-loop straps, hence the locking strap 11 guarantees a better traction resistance.

Furthermore, the locking strap 11 can be replaced and/or adapted to the user's needs with extreme quickness, with the ensuing greater fitting comfort. The length $\ell$ of bight 17, in fact, can be easily varied, or rather reduced, by changing configuration and/or by making one or more knots directly on the flexible cord 16.

Additionally, the locking strap 11 better adapts to the morphology of the instep of the user's foot, with the ensuing greater fitting comfort.

It is finally clear that modifications and variations may be made to the climbing shoe 1 without thereby departing from the scope of the present invention.

For example, the bight formed by the flexible cord 19 may have a length such that it can be knotted to the loop 12 additionally or alternatively to the bight 17 formed by the flexible cord 16.

Clearly, in this case, the flexible cord 19 would no longer form the supplementary loop 18 of the plate-like head 15.

In addition, the closure device 10 could comprise a pair of loops 12 which are located on the inner lateral side of the shoe-upper 2, preferably close to the elasticized portion 8 and/or the top opening. The locking strap 11, moreover, may engage one or both loops 12.

Moreover, in a different embodiment of the closing device 10, the loop 12 may be located on the outer lateral side of the shoe-upper 2, whereas the anchoring flap or insert 13 may be located on the inner lateral side of the shoe-upper 2.

Additionally, in a more sophisticated embodiment of the locking strap 11, one of the two ends of the flexible cord 16 may be fixed to the plate-like head 15 in a manually adjustable manner, so as to allow the user to adjust at pleasure the total length of the flexible cord 16 and thus the length $\ell$ of the bight 17.

Figure 5:
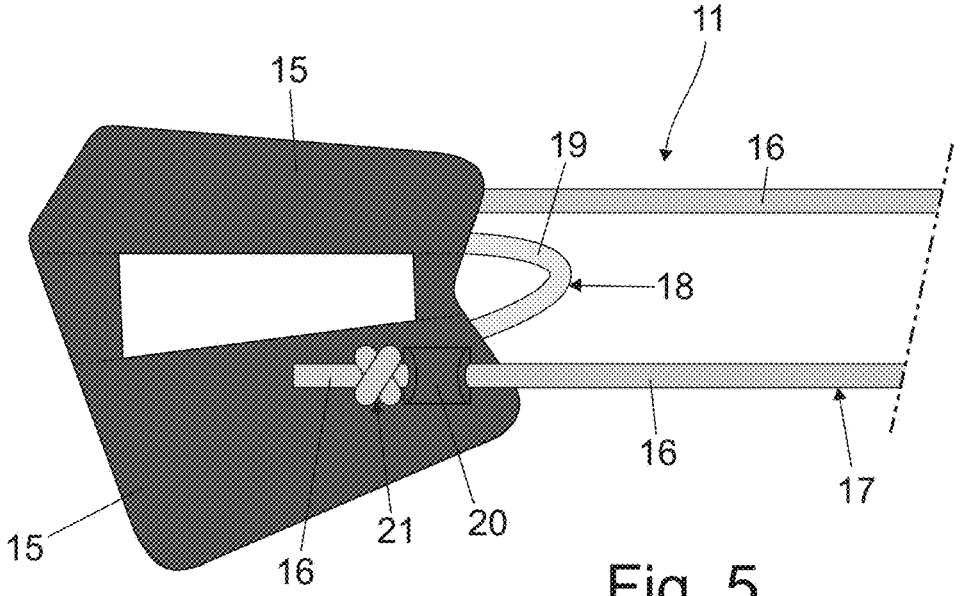
FIG. 5 is a plan view of a second embodiment of the component illustrated in FIG. 4, with parts removed for clarity's sake.

More specifically, with particular reference to FIG. 5, the plate-like head 15 is preferably moreover provided with a small U-bolt fairlead 20, which is adapted to be engaged in a pass-through and free slidable manner by the flexible cord 16.

In this embodiment, the flexible cord 16 has, downstream of the U-bolt fairlead 20, a large stop knot 21 (for example a figure-of-eight knot) capable of preventing the slipping away of the flexible cord 16 from the U-bolt, and thus from the plate-like head 15.

The position of the stop knot 21 on the flexible cord 16 determines the length $\ell$ of the bight 17 and can be varied at pleasure by the user of the climbing shoe 1 depending on his/her needs.

Clearly, the U-bolt fairlead 20 can be replaced by an eyelet, a through hole, a small cable choker or the like.

The invention claimed is:

1. A climbing shoe (1) comprising: a shoe-upper (2) which is shaped so as to accommodate substantially an entire user's foot and has a bottom, a first and a second lateral sides opposite to one another, and a top part; a sole (3) made of a polymeric material, which is attached to the bottom (4) of the shoe-upper (2) so as to cover at least a front part of the bottom (4) of said shoe-upper (2); and manually-operated closing means (10) that are adapted to tighten the top part of the shoe-upper (2) on the user's foot;

the closing means (10) comprising a transversal locking strap (11) that extends like a bridge between said first and second lateral sides of the shoe-upper (2) remaining astride and grazing the top part of the shoe-upper (2), and is adapted to pull the same first and second lateral sides of the shoe-upper (2) toward each other;

wherein said locking strap (11) comprises: a plate-like head (15) which has, on at least one of its two major faces, a first hook-and-loop surface structure; and a first flexible cord (16) that has its two ends firmly fixed to the plate-like head (15), so as to form a large, substantially U-shaped bight (17); and wherein the closing means (10) comprise a first loop (12) which is located on a first lateral side of the shoe-upper (2): the bight (17) of said locking strap (11) being adapted to be threaded into and/or knotted to said first loop (12); and wherein the plate-like head (15) of said locking strap (11) is shaped and dimensioned so as not to be able to pass through said first loop (12), and has a semi-rigid foldable structure so as to be able to pass through the first loop (12) when in a folded configuration.

2. The climbing shoe according to claim 1, wherein the closing means (10) additionally comprise an anchoring flap or insert (13) which is located on the second lateral side of the shoe-upper (2) and is provided, on its exposed face, with a second hook-and-loop surface structure complementary to the hook-and-loop surface structure of the plate-like head (15); the plate-like head (15) of said locking strap (11) being adapted to hook/attach firmly, though in easily removable and adjustable manner, onto said anchoring flap or insert (13).

3. The climbing shoe according to claim 2, wherein the closing means (10) additionally comprise a second loop (14) which is located on the second lateral side of the shoe-upper (2), immediately above said anchoring flap or insert (13); the bight (17) of said locking strap (11) being adapted to be threaded into and/or knotted also to said second loop (14).

4. The climbing shoe according to claim 1, wherein the top part of the shoe-upper (2) is provided with an oblong-shaped elasticized portion (8) extending from a top opening (9) of the shoe-upper (2) toward a tip of the shoe, so as to cover the instep of the user's foot; said locking strap (11) being arranged astride and grazing said elasticized portion (8).

5. The climbing shoe according to claim 4, wherein the closing means (10) additionally comprise an anchoring flap or insert (13) which is located on the second lateral side of the shoe-upper (2) and is provided, on its exposed face, with a second hook-and-loop surface structure complementary to the hook-and-loop surface structure of said plate-like head (15); and wherein said first loop (12) and said anchoring flap or insert (13) are arranged on opposite sides of said elasticized portion (8).

6. The climbing shoe according to claim 1, wherein the plate-like head (15) of the locking strap (11) is furthermore provided with a third loop (18), which is selectively engageable by the bight (17) of the locking strap (11).

7. The climbing shoe according to claim 1, wherein the transversal locking strap (11) additionally comprises a second flexible cord (19), separate and distinct from said first flexible cord (16), which has its two ends firmly fixed to the plate-like head (15) so as to form a second substantially U-shaped bight, which has a length less than that of said first bight (17).

8. The climbing shoe according to claim 1 wherein the plate-like head (15) is substantially polygonal in shape and/or is made of plastic material.

9. The climbing shoe according to claim 1, wherein the two ends of said first flexible cord (16) are firmly fixed to the sidewall of said plate-like head (15).

10. The climbing shoe according to claim 1, wherein one of the two ends of the first flexible cord (16) is fixed to the plate-like head (15) in a manually adjustable manner.

11. The climbing shoe according to claim 1, characterized by additionally comprising one or more tensioning bands (5, 6, 7) that are made of elastomeric material and are firmly attached to the shoe-upper (2) so as to embrace and tighten the shoe-upper (2) on the user's foot.

12. The climbing shoe according to claim 1, wherein the first lateral side of the shoe-upper (2) is an inner lateral side of the shoe-upper (2), and the second lateral side of the shoe-upper (2) is an outer lateral side of the shoe-upper (2).

* * * * *